United States Patent [19]

DeGore

[11] Patent Number: 4,548,376

[45] Date of Patent: Oct. 22, 1985

[54] SUPPORT RECEPTACLE FOR A NEWSPAPER, MAGAZINE OR THE LIKE

[76] Inventor: James A. DeGore, 4308 Frank St., Pittsburgh, Pa. 15217

[21] Appl. No.: 428,959

[22] Filed: Sep. 30, 1982

[51] Int. Cl.[4] ..... A47H 1/10

[52] U.S. Cl. ..... 248/205.4; 248/230

[58] Field of Search ..... 248/205.4, 225.2, 225.31, 248/231.9, 231.4, 231.8, 230, 213.4, 214, 215, 309 R; 211/86, 87; 232/1 C; 138/171

[56] References Cited

U.S. PATENT DOCUMENTS

| | | | |
|---|---|---|---|
| 435,173 | 8/1890 | Forbes | 248/226.5 |
| 1,656,426 | 1/1928 | Cunningham | 232/1 C |
| 1,861,220 | 5/1932 | Marquis | 211/87 |
| 2,472,058 | 6/1949 | Artley | 248/226.5 |
| 3,030,058 | 4/1962 | Rosing | 248/205 R |
| 3,275,228 | 9/1966 | Golla | 232/1 C |

FOREIGN PATENT DOCUMENTS

| | | | |
|---|---|---|---|
| 2439350 | 5/1980 | France | 248/226.5 |

*Primary Examiner*—Ramon S. Britts
*Assistant Examiner*—Ramon O. Ramirez
*Attorney, Agent, or Firm*—Lawrence G. Zurawsky

[57] ABSTRACT

A holder to support an article such as a folded or rolled newspaper or magazine or a book or the like includes an elongated carrier receptacle in the form of a rolled web flexible material. The receptacle has an access opening at one end thereof to permit loading and unloading of an article. A hanger is connected to the receptacle and provides an inverted "U" shaped end section to partly encircle an upwardly facing rim section of a toilet closet. A shank portion of the hanger extends from the "U" shaped end section into supporting engagement with the receptacle. A wall section extends along an outer part of the receptacle to form an additional pocket for supporting an article.

2 Claims, 3 Drawing Figures

SUPPORT RECEPTACLE FOR A NEWSPAPER, MAGAZINE OR THE LIKE

BACKGROUND OF THE INVENTION

Figure 1:
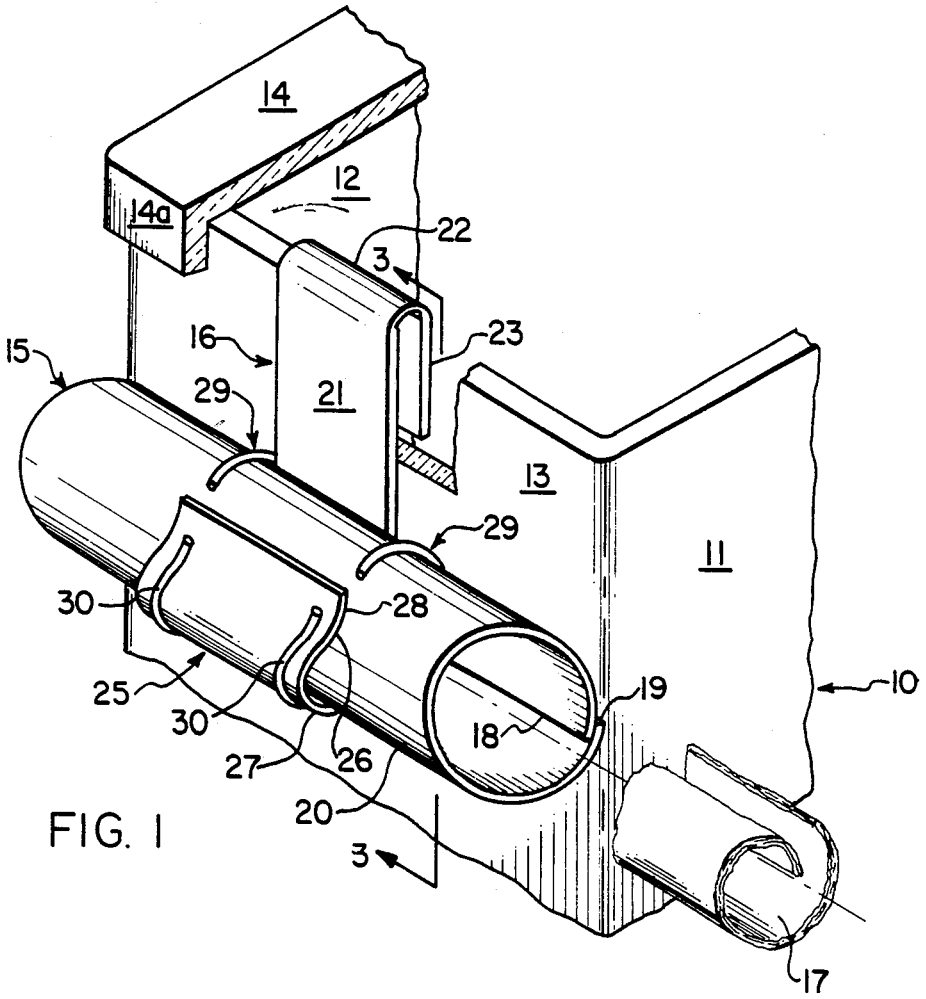

This invention relates to an auxiliary device adapted for support by a toilet assembly to provide a convenient storage and/or carrier for an article of any one of a number of diverse forms such as a folded or rolled newspaper or magazine or a book or the like. More particularly the present invention relates to a novel construction and arrangement of parts for a holder to carry such articles while supported by a toilet assembly.

The present invention is designed to economically alleviate a desire to maintain a safe convenient storage for anyone of a number of diverse kinds of reading material that specifically includes a newspaper, or a magazine. The invention is particularly intended to avoid the general clutter that can arise because of a lack of storage facility for such material in a bathroom. For example, if a newspaper is allowed to remain on a floor or vanity top, it may become inadvertently saturated with water which is obviously undesirable. The site at which such articles can be stored is a generally limited within the environment of a bathroom, for example, and it is important that the storage site be relatively free from contamination by water that may be spilled upon the floor or splashed inadvertently. Moreover, it is desirable to provide a structure that is relatively inexpensive to procure and will not present an undue hazard because of its placement and use.

SUMMARY OF THE INVENTION

It is an object of the present invention to provide a holder for an article such as a newspaper or magazine which is convenient to use and readily adapted for installation at a selected support site which is preferably between a lid and the upper rim section of a water closet portion of a toilet assembly such that the support site for the holder is a generally located at a sidewall defining the depth of the water closet.

More particularly according to the present invention there is provided such a holder comprising an elongated carrier receptacle defining a support area with an access opening at one end thereof to permit loading and unloading of an article in the receptacle, and a hanger means for the receptacle, the hanger means having an inverted "U" shaped end section to partly encircle an upwardly facing rim section of a toilet assembly with a shank portion extending externally thereof into supporting engagement with the receptacle.

In its preferred form, the holder comprises a rolled web of flexible material with two opposite marginal edge portions secured together by fastening means to form a generally elongated carrier receptacle, and a hanger mounting means for the rolled web, the hanger mounting means having an end section to partly encircle an upwardly facing rim section of a toilet assembly with a shank portion extending outside the bowl into supporting engagement with the rolled web along the length thereof. The preferred form of holder is further characterized by the fact that the carrier receptacle is generally cylindrical and that the hanger mounting means comprises a web section of resilient material having sufficient flexibility to form an inverted "U" shaped configuration when engaged with the rim section.

Figure 2:
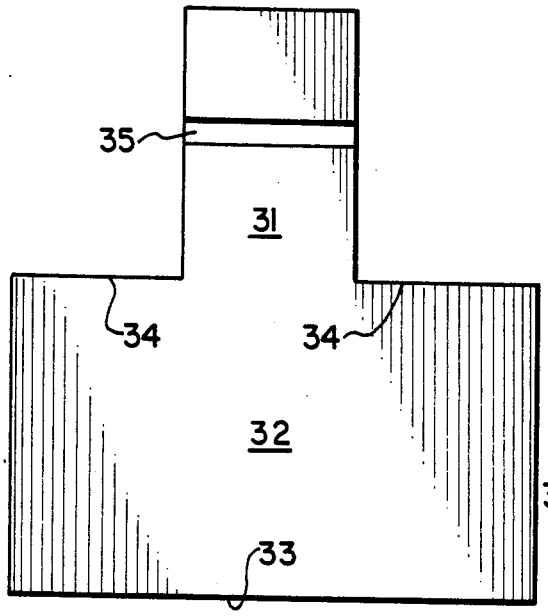

These features and the advantages of the present invention as well as others will be more fully understood with the following description read in light of the accompanying drawings in which FIG. 1 is an isometric view partly in section illustrating the holder of the present invention; and FIG. 2 is a plan view of a cut web of flexible material to form the preferred embodiment of the holder shown in FIG. 1.

Figure 3:
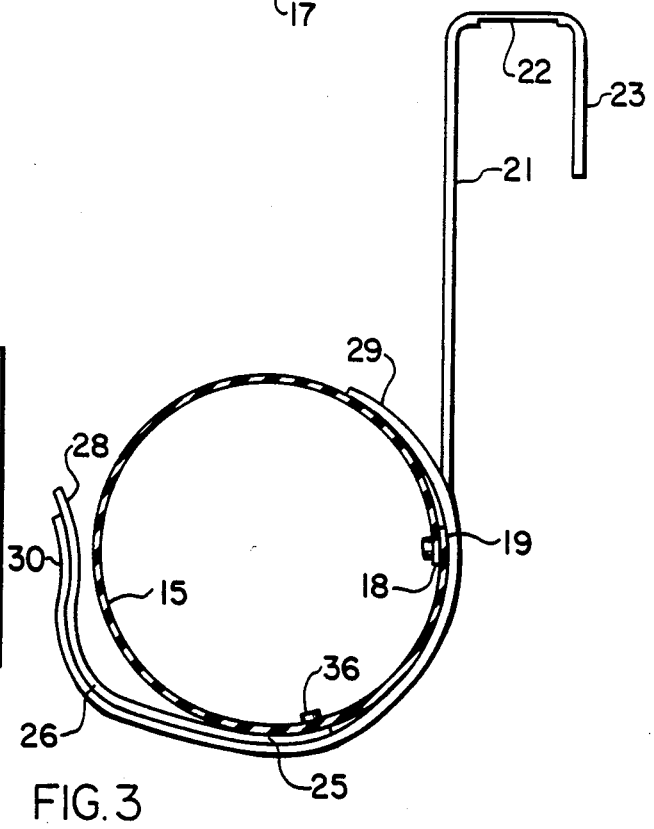

FIG. 3 is a sectional view taken along the line 3—3 of FIG. 1 further illustrating the assembly of the embodiment of FIG. 1.

FIG. 1 illustrates the upper portion of a water closet 10 forming part of a conventional toilet assembly. The water closet includes a front wall 11, a rear wall 12 and two side walls 13, only one of which is shown. A top 14 that includes a depending rim section **14*a*** that extends downwardly from the outer peripheral of the top as shown.

As will be obvious to those skilled in the art in light of the following description, the holder of the present invention may be supported by a convenient and accessible horizontal edge surface such as defined by the horizontal top of end wall 13 forming part of the water closet for a toilet assembly. The holder assembly essentially includes an elongated carrier receptacle 15 and a hanger means 16. The receptacle and hanger means may be an integral structure formed by molded plastic material. The receptacle, as shown in FIG. 1, defines a support area which in the embodiment as shown in FIG. 1 has a cylindrical shape surrounded by a tubular wall 20 so as to form access opening at one end thereof to permit the loading and unloading of an article in the receptacle. In FIG. 1 the article is identified by reference numeral 17 and typically comprises a rolled newspaper or magazine. The receptacle will not include seamed edges when it constructed from molded plastic. However as will be described in greater detail hereinafter in regard to FIG. 2, the receptacle may be comprised of a sheet of flexible material in which opposite longitudinal end portions 18 and 19 are fastened together by means such as adhesive, rivets or other suitable fasteners. The carrier is preferably a generally cylindrical element although when constructed of yieldable plastic or rubber material, it may distort under its own weight from a generally cylindrical configuration. The hanger means 16 extends upwardly from the receptacle. The hanger means is preferably arranged so that the support area of the receptacle is generally horizontal with respect to the extended length thereof.

The support means includes a shank portion 21 joined with a reversely bent end section 22 having a generally "U" shaped configuration to partly encircle the upwardly facing rim section of the water closet for the toilet assembly. An end portion 23 of the hanger means extends downwardly along the inside surface of the water closet so as to prevent an inadvertent dropping of the hanger means from supporting engagement with the water closet. It is preferable to provide the inverted "U" shaped end section 22 with a reduced thickness to assure that the top 14 will pass onto the water closet without creating a major unsupported relation with side walls 11–13. Section 22 also provides an anchor for the hanger means to prevent unwanted withdrawal of the hanger particularly when constructed of yieldable flexible material.

To install the holder of the present invention, the top 14 is removed from the water closet and the inverted "U" shaped section 22 is placed over the top edge of side wall 13. Thereafter the top can be replaced into a normally closed relation with the top of the water closet. The length of the shank portion 21 is selected so that the receptacle extends preferably horizontally at an elevation spaced only several inches below the top edge of the water closet to maintain an article supported in the receptacle above the floor and at a site which is generally free from even accidentally disbursed amounts of water or liquid from a shower, vanity, commode or the like.

It is preferred to provide that the receptacle of the present invention include an externally situated wall section 25 having a reversely bent configuration with respect to its extended length along the outside surface of the receptacle. The reversely bent configuration to wall section 25 provides that the mid-portion of the wall section is spaced or may actually touch the mid-portion of the wall forming the receptacle 15. The closely spaced mid-portion is identified in FIG. 1 by reference numeral 26. Below mid-portion 26 there is an outwardly extending bottom wall section 27 which forms a pocket to receive an article to be stored or supported externally of the receptacle. To facilitate entry of the article into the space between the wall section 25 and the receptacle 15, an upper wall section 28 has an outwardly bent edge portion. A frame 29 made of resilient wire for example is partially wrapped around the circumference of the receptacle and provided with support legs 30 that extend along the outer face surface of wall section 25 to provide added support against forces developed thereon by an article placed between the wall section and the receptacle.

As shown in FIG. 3, the wall section 25 may be secured by means of fasteners 36 to the receptacle 15. It may be desirable to provide supplemental support for the wall section 25 by means of resilient wires 29 which are in peripheral engagement with the outside surface of the receptacle 15 and which support the wall 25 particularly in the region of the mid-portion 26 and upper wall section 28. In place of the riveted connection 36, other fastening means might be employed such as adhesives.

Turning now to FIG. 2 there is illustrated the configuration of a cut sheet or web of flexible material to form a holder of the present invention. The flexible material may be comprised of molded rubber or plastic to impart a liquid resistant characteristic to the area of the holder. The web of flexible material has a width which corresponds to the length of the receptacle. The web has rectangular sections removed from a portion of its length so that the web has a generally T-shaped configuration with a stem section 31 connected to a head section 32. The head section has two opposite edge portions 33 and 34, the latter being on opposite sides of the stem section 31. When viewing FIG. 2, head section 32 has a lower edge which corresponds to edge portion 18 and edge portions 34 adjacent stem section 31 form edge portions 19, portions 18 and 19 being previously described in regard to FIG. 1. The stem portion 31 of the flexible web forms a hanger means that is integral with the receptacle. Reference numeral 35 identifies a transverse area of reduced thickness which has increased flexibility because of the reduced thickness and can be readily bent to form an inverted "U" shaped section which will wrap around the upper edge portion of wall section 13 (FIG. 1). By way of example only, the web may have a thickness of ⅛ inch and the area 35 may have a thickness of about 1/16 inch. Alternatively, however, a web of 1/16 inch in thickness can be used and retainer strips attached at a spaced apart relation to form a transverse area corresponding to area 35 to wrap around the upper edge of the water closet. The attached strips will anchor the shank portion of the holder to the water closet and prevent inadvertent slippage of the hanger means from the water closet particularly under the load imposed by an article supported in the receptacle.

Although the invention has been shown in connection with a certain specific embodiment, it will be readily apparent to those skilled in the art that various changes in form and arrangement of parts may be made to suit requirements without departing from the spirit and scope of the invention.

I claim:

1. A holder carried by a toilet assembly to support an article such as folded or rolled newspaper or magazine or a book or the like, said holder comprising an elongated carrier receptacle having a generally cylindrical shape defining a support area with an access opening at one end thereof to permit loading and unloading of an article in said receptacle, and a hanger means for said receptacle, said hanger means having an inverted "U" shaped end section to partly encircle an upwardly facing rim section of a toilet assembly with a shank portion extending externally thereof into supporting engagement with said receptacle, a wall section extending externally of the support area defined by said receptacle at a site generally opposite said hanger means to form a yieldable external pocket for receiving an article passed between the wall section and said receptacle.

2. The holder according to claim 1 wherein said wall section extends into close proximity with said receptacle while other portions of said wall section are spaced therefrom.

* * * * *